US006078018A

United States Patent [19]

Davis et al.

[11] Patent Number: 6,078,018

[45] **Date of Patent: *Jun. 20, 2000**

[54] SORTING APPARATUS

[75] Inventors: Robert Davis; Herbert Fraenkel; Kenneth Henderson, all of London, United Kingdom

[73] Assignee: Sortex Limited, London, United Kingdom

[ * ] Notice: This patent is subject to a terminal disclaimer.

[21] Appl. No.: 09/240,097

[22] Filed: Jan. 29, 1999

Related U.S. Application Data

[63] Continuation of application No. 08/739,021, Oct. 28, 1996, Pat. No. 5,873,470, which is a continuation of application No. 08/660,606, Jun. 6, 1996, Pat. No. 5,692,621, which is a continuation of application No. 08/333,498, Nov. 2, 1994, Pat. No. 5,538,142.

[51] Int. Cl.[7] ..... B07C 5/342

[52] U.S. Cl. ..... 209/580; 209/587; 209/938; 250/226; 356/406

[58] Field of Search ..... 209/555, 559, 209/576, 580, 581, 582, 587, 639, 938, 939; 250/222.2, 226, 561; 356/338, 343, 402, 406, 407

[56] References Cited

U.S. PATENT DOCUMENTS

| | | |
|---|---|---|
| 4,203,522 | 5/1980 | Fraenkel et al. . |
| 4,600,105 | 7/1986 | Van Zyl et al. . |
| 5,135,114 | 8/1992 | Satake et al. . |
| 5,158,181 | 10/1992 | Bailey . |
| 5,201,576 | 4/1993 | Squyres . |
| 5,303,037 | 4/1994 | Tanonowski . |
| 5,352,888 | 10/1994 | Childress . |
| 5,443,164 | 8/1995 | Walsh et al. . |
| 5,538,142 | 7/1996 | Davis et al. . |
| 5,692,621 | 12/1997 | Davis et al. . |
| 5,873,470 | 2/1999 | Davis et al. ..... 209/555 |

FOREIGN PATENT DOCUMENTS

| | | |
|---|---|---|
| 279041 | 8/1988 | European Pat. Off. . |
| 396290 | 11/1990 | European Pat. Off. . |
| 402543 | 12/1990 | European Pat. Off. . |
| 443769 | 8/1991 | European Pat. Off. . |
| 554850 | 8/1993 | European Pat. Off. . |
| 223446 | 5/1997 | European Pat. Off. . |
| 4331772 | 3/1995 | Germany . |
| 6063514 | 3/1994 | Japan . |
| WO9603226 | 2/1996 | WIPO . |

*Primary Examiner*—Tuan N. Nguyen
*Attorney, Agent, or Firm*—Majestic, Parsons, Siebert & Hsue

[57] ABSTRACT

Sorting apparatus has a conveyor belt or equivalent mechanism for moving particles at a speed sufficient to generate a stream of particles in air, which particles can be graded such that selected material can be removed. The grading or sorting is conducted by a primary scanning system for analysing light reflected from particles in the stream in a plurality of wavelength ranges. Ejectors for removing particles from the stream are disposed downstream of the scanning system, and are instructed in response to signals received from the scanning system. An auxiliary scanning system is also included to establish the presence of material in the stream, and in the event that a void is detected in a given region, then the analysis of that region by the primary scanning system and any corresponding activation of the ejectors is inhibited. If the auxiliary scanning system operates on the basis of light transmitted in the infra-red wavelength, then the scanning system can differentiate between a situation in which it is receiving light reflected from a product piece in a product stream, and light transmitted across the path of the product stream in the absence of a product piece therefrom. By this means, the monitoring of light received from the path of the product stream in the infra-red range can be used to perform all functions.

7 Claims, 4 Drawing Sheets

SORTING APPARATUS

CROSS-REFERENCE TO RELATED APPLICATIONS

This is a continuation of application Ser. No. 08/739,021, filed Oct. 28, 1996, now U.S. Pat. No. 5,873,470, which is a continuation-in-part of application Ser. No. 08/660,606, filed Jun. 6, 1996, now U.S. Pat. No. 5,692,621, which in turn is a continuation of application Ser. No. 08/333,498, filed Nov. 2, 1994, now U.S. Pat. No. 5,538,142.

BACKGROUND OF THE INVENTION

This invention relates to sorting apparatus. It is particularly concerned with sorting apparatus which grades particles in a flowing stream according to their color characteristics, and activates an ejection mechanism based on that grading to remove selected particles from the stream.

A particular color sorting apparatus of the above type is available from Sortex Limited of London, England under the designation Sortex 5000. That apparatus uses a bichromatic system for scanning particulate material in free flow through air, which system grades each particle in the stream, and instructs ejectors located downstream to remove from the stream particles not matching the predetermined acceptance criteria.

Various sorting apparatus which grade particulate material according to its ability to reflect light in different wavelength ranges are described in U.S. Pat. Nos. 3,066,797; 4,203,522; 4,513,868; and 4,699,273, the disclosures whereof are incorporated herein by reference. Reference is also directed to British Patent No. 993,063. In apparatus disclosed in the '522 patent detectors are responsive to light reflected from the particles in different wavelength ranges and generate signals indicative of different qualities of the product. These signals are compared and analyzed, to generate a comparison signal which can activate an ejector to remove the relevant particle from the product stream Problems can arise in sorting apparatus of the above general type if some individual particles in the product stream are of different sizes. A larger dark product can in some circumstances reflect more total light than a much smaller light object. These problems can to some extent be met by the use of carefully selected background colors, but this solution usually involves a degree of compromise, even where a line scan system is employed. One of the problems in a line scan system is that spaces between products can appear as for example, dark defects. To obtain a matched background across the whole extent of the line scan the variation in illumination across the corresponding particles would have to be correlated both in color and brightness to the background. Even if this were attainable, it would be difficult to maintain in operation. A further degree of enhancement and flexibility in bichromatic sorting may be achieved by creating a say, red/green Cartesian map divided into accept and reject portions. Any background would limit and complicate the full implication of such a method of operation. thus, the best solution is to eliminate the background from the color measurement.

SUMMARY OF THE INVENTION

According to this invention, a primary scanning system in sorting apparatus is supplemented by an auxiliary scanning system which is used to establish the presence of particulate product in the stream being sorted. If the auxiliary system indicates the absence of any product particle from an area, then a signal is dispatched to inhibit activation of any ejector mechanism for that area. Normally, such a signal will inhibit the output from the primary scanning system itself for that area. By effectively excluding from the scanning mechanism areas of the product stream cross-section which are not occupied, the primary scanning system-can be programmed more specifically, and without risk of a sorting error as a result of falsely identifying a background as reject product. The primary scanning system can be mono or multichromatic, but is most usually bichromatic.

A particular apparatus according to the invention comprises means for moving a stream of particles along a predetermined path; a primary, normally bichromatic, scanning system for analyzing light reflected from particles on the moving path in a plurality of wavelength ranges; ejectors disposed downstream of the scanning system for removing particles from the particle stream; and means for activating the ejectors in response to signals from the scanning system, to remove selected particles from the product stream. the primary scanning system is supplemented by an auxiliary scanning system disposed to receive light transmitted across the product stream from a background adapted to emit light in a further, different wavelength range, and this auxiliary system is coupled to the primary system to inhibit activation of the ejectors, or indeed operation of the primary scanning system in an area or areas of the product stream through which such light has been transmitted directly from the background to the auxiliary system. By this mechanism it will be understood that the primary scanning system can be operated on the basis that all the light it analyses is light reflected from material in the product stream.

In order of course to ensure that the signals generated by the auxiliary scanning system are accurate, it is important to ensure an adequate intensity of the background lighting. To this end, it is preferred in apparatus according to the invention to create the background in the form of a light beam reflected from the surface of a rotating cylinder which can be under continuous cleaning.

Apparatus according to the invention will normally include a bichromatic scanning system adapted to analyze reflected light in the visible wavelength ranges, typically "red" and "green". The background to the auxiliary system is also preferably generated using light in a different visible wavelength range, and thus "blue" could be used in this case. The bichromatic scanning system can then comprise a visible light camera with an infra-red blocking filter between it and the product stream. This is usual practice to eliminate infra-red to which the three color array are also sensitive in for example, the KODAK KLI2103. The "red", "green", and "blue" detectors in the Kodak array are located such that the viewed light from the locations in the product stream are spaced from each other in the direction of movement. A computer or microprocessor will usually be included in the apparatus to store and compensate for the sequential timing of the outputs of the rows of color sensitive pixels in the scanning systems, and make appropriate adjustments in the processing before instructing the ejectors.

It is also possible to include an additional infrared scanning assembly in combination with the primary and auxiliary scanning systems already described. This can use a similar system to that described with reference to the visible light emissions, preferably also using a visible light blocking filter instead of the infra-red blocking filter employed there. In the infra-red scanning array the normally built in color filters can be omitted. As noted above, light of different wavelength ranges can be mixed to create the background, and light in the infra-red range can easily be included. This infra-red scanning assembly would be used as a "dark" or "light" sort, broadly in the same way as it is described in U.S. Pat. No. 4,203,522 referred to above. Alternatively, the sensor in the infra-red scanning system can be made responsive to the for example, "blue" background so that the infra-red illumination on the background would not be required in a "dark" only sort.

In a further development, we have found that the infra-red scanning assembly can be effectively incorporated in the primary scanning system discussed above to serve a dual purpose. The infra-red assembly can be used for auxiliary scanning to monitor the presence or absence of product from the scanning area, and at the same time to conduct a "dark" and/or "light" sort. Because of the intensity of the infra-red illumination, the infra-red sensor can be programmed to recognise a threshold quantity of light received as indicating the clear absence of a product piece from the viewing zone. Broadly, the quantity of the light received in the absence of a product piece from the viewing zone will be of the order of twice the amount received when a product piece is there. This difference is sufficient to enable the same sensor or group of sensors to be used simultaneously to achieve two objectives.

This development enables all the scanning phases to be conducted at substantially the same stage. As a consequence, the need for the computer to store and correlate signals received from different systems is reduced.

The invention will now be described by way of example and with reference to the accompanying schematic drawings.

DESCRIPTION OF THE PREFERRED EMBODIMENTS

Figure 1:
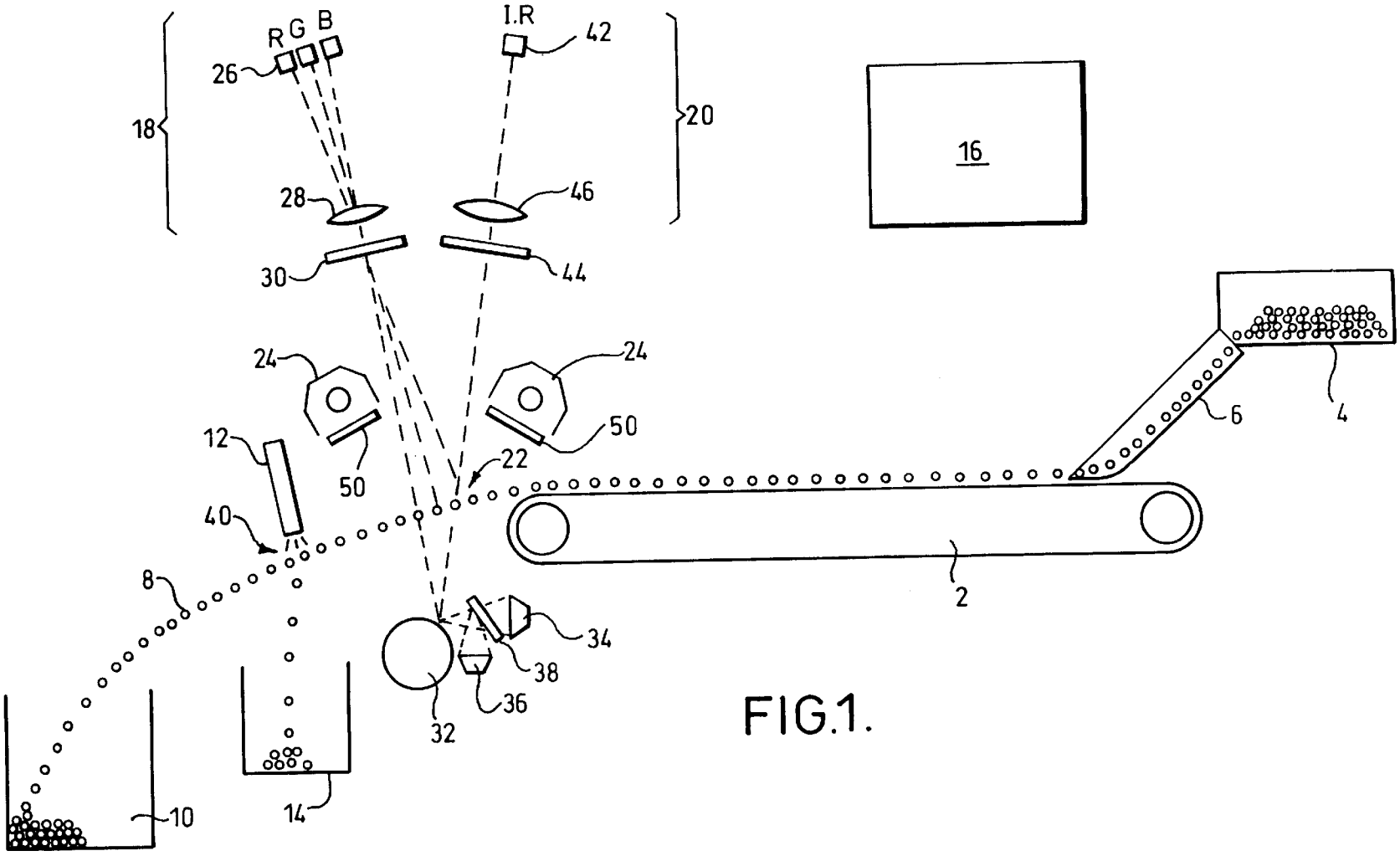
FIG. 1 illustrates diagrammatically the operation of apparatus according to the invention.

FIG. 1 illustrates a conveyor 2 to which particulate material is fed from a hopper 4 down to a chute 6. The conveyor belt is driven such that its upper level moves from right to left as shown at a speed (for example, 3 meters per second) sufficient to project material in a product stream 8 to a receptacle 10. During its passage from the end of the conveyor 2 to the receptacle 10, the material is kept in the product stream 8 solely by its own momentum. Ejectors 12 extend over the width of the product stream 8, and are operable to remove particles from specific zones of the product stream 8 by high pressure air jets, directed towards the reject receptacle 14. Typically, the lateral width of the product stream is 20 inches, with forty ejector nozzles equally spaced thereover. The ejectors 12 are instructed by a computer or microprocessor 16, which itself receives input data from the scanning systems 18 and 20 described below.

Reference numeral 22 indicates a region in the product stream 8 where the product is scanned. Region 22 is illuminated by a light source 24, with a blue light blocking filter 50, and particles in the region 22 reflect light which is received in the scanning assembly 18. The assembly 18 comprises essentially a visible light camera 26, lens 28, and infra-red light blocking filter 30 The camera 26 comprises charge coupled devices which monitor light received in specified visible light wavelength ranges, in this case three, "red", "green", and "blue" (R, G, B) The charge coupled devices in the camera 26 are arranged in rows with each viewing range extending the entire lateral dimension of the product stream.

As shown, particles at the entrance to the scanning zone are first scanned for reflected light in the "red" wavelength range. It is then examined for reflected light in the "green" wavelength range, before finally being examined for light in the "blue" range. For most sorting processes for which apparatus according to the present invention is used, a product can be satisfactorily graded on the basis of reflected light in the "red", and "green" wavelength ranges. The "blue" detector array is therefore not used as part of the grading process, but to determine whether that area in the product stream is occupied at all. The "blue" detector array is aligned with a cylinder 32 on the other side of the product stream 8, which is itself illuminated by blue light source 34 and infra-red light source 3G using a dichroic or partially silvered mirror 38 as indicated. The purpose of the infra-red lamp will be described below. The background illumination could alternatively or additionally he provided by suitably colored, possibly flashing LED's.

The "red" and "green" light detectors generate signals which are passed to the computer 16 which conducts a bichromatic sort analysis of particles in the product stream as is known in apparatus of this type. If the analysis indicates that a particle is defective, then the computer 16 instructs one or more of the battery of ejectors 12 to remove that particle from the stream by the delivery of an air pulse to the appropriate section of the stream in the removal zone 40. Such removed particles are deflected from the path of the product stream into the reject receptacle 14.

So long as the product stream is filled with particles, then the "blue" detector will remain inactive. However, when spaces appear, the blue light from the source 34 reflected by the roller 32 will be recognized by the "blue" detector as indicating the absence of any product material in the particular areas. In response to this event, the blue detector generates a signal which is transmitted to the computer 16, and upon receipt of which the computer inhibits its bichromatic analysis of that particular area and also any activation of the ejectors therefor.

Because of the sequential involvement of the red, green and blue detectors, and the downstream disposition of the removal zone 40 relative to the scanning zone 22, the signals therefrom are stored in memories in the computer 16 prior to analysis. This also enables analysis of the signal from the blue detector and this of course, means that the signals from the red and green detectors can be ignored or discarded if analysis of a signal from the blue detector indicates the absence of any particle from the product steam in a given area. Thus, the reception of an "inhibit" signal from the blue detector effectively prevents analysis of the signals from the red and green detectors.

As noted above, the rotating surface of the drum 32 is also illuminated with light in the infra-red wavelength range, and an additional detector 42 in the form of a single line array of charge coupled devices is included to watch for such reflected light. The detector 42 receives light from the drum 32 along a path through the product stream 8 at the upstream end of the scanning zone, a visible light blocking filter 44 and a focusing lens 46. This scanning system enables an additional dark and/or light sort to be obtained, depending upon the brightness of the infra-red light source 36 which can also of course be conducted quite independently of the inhibiting activity of the blue detector in the camera 26. Thus, signals generated by the detector 42 will again be transmitted to the computer 16, but analyzed quite separately to instruct the ejector 12 as appropriate.

Figure 2:
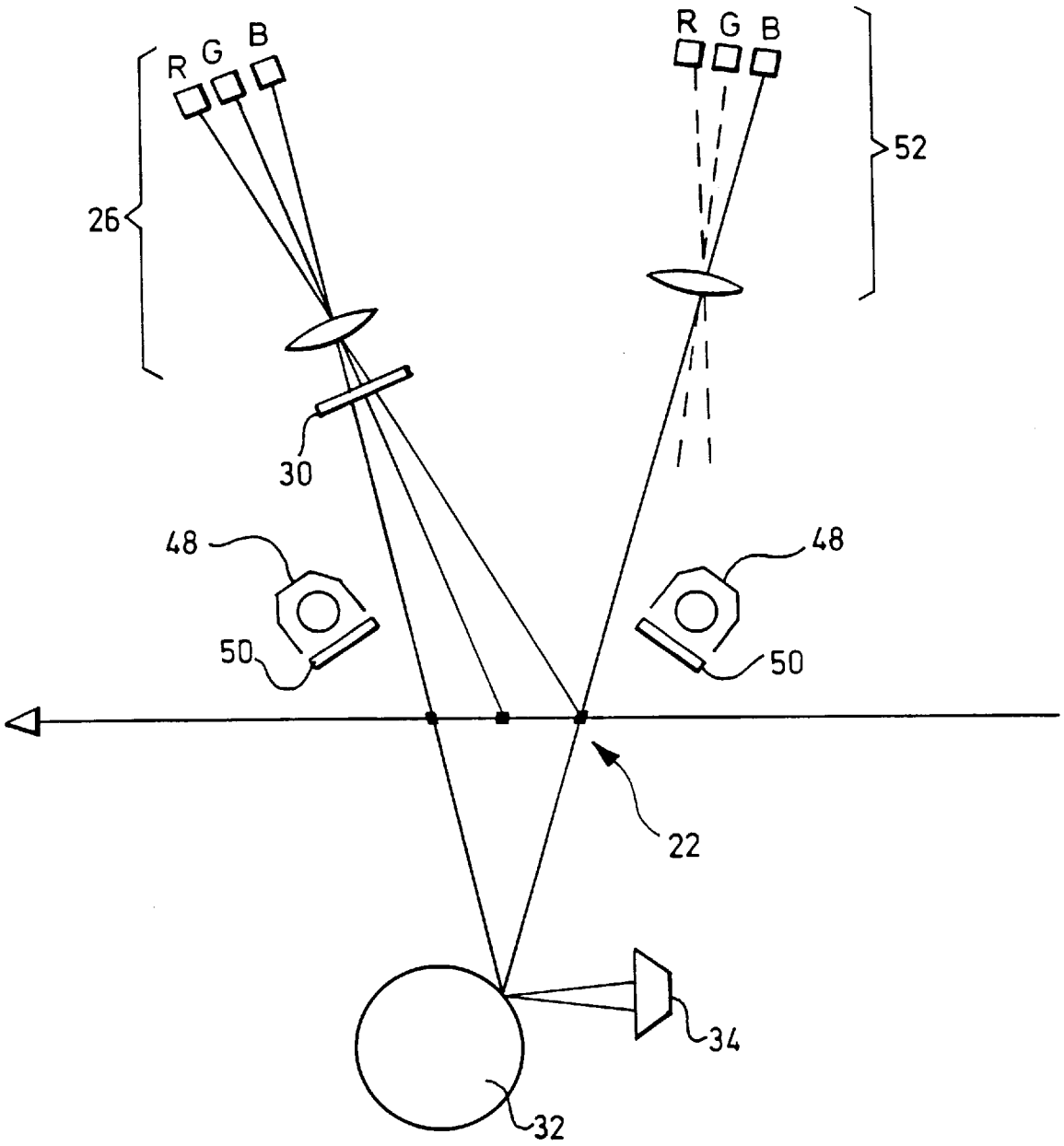
FIG. 2 shows a modification of the apparatus of FIG. 1.

In the modification shown in FIG. 2, the visible light camera 26 operates in the same way as does the camera 26 in FIG. 1, to receive reflected light from particles in the product stream 8 in the scanning region 22. The region 22 is illuminated by light sources 48 which have blue light blocking filters 50, and any blue light transmitted across the product stream 8 from roller 32 is received and monitored by the "blue" detectors in camera 26. However, the sources 48 also emit light in the infrared wavelength range, and an infra-red camera 52 is used to monitor reflected light in the blue and infra-red ranges. The camera 52 is of the same type as the camera 26, but uses only the blue detector array which responds in the "blue" range (400 to 500 nm) and in the infra-red range (700 to 1000 nm). Thus the camera 52 will generate a "light" output when viewing either bright infra-red reflected from particles in the product stream 8 or the blue background, and correspondingly the camera 52 will give a dark output when viewing an infra-red absorbing particle Signals generated by the camera 52 are also processed by the computer 16 to activate the appropriate ejector when a product particle comes into view which is darker in Ir relative to the "blue" background than a set limit. This enables an IR "dark" sort to be conducted simultaneously with the bichromatic sort conducted using the camera 26

Figure 3:
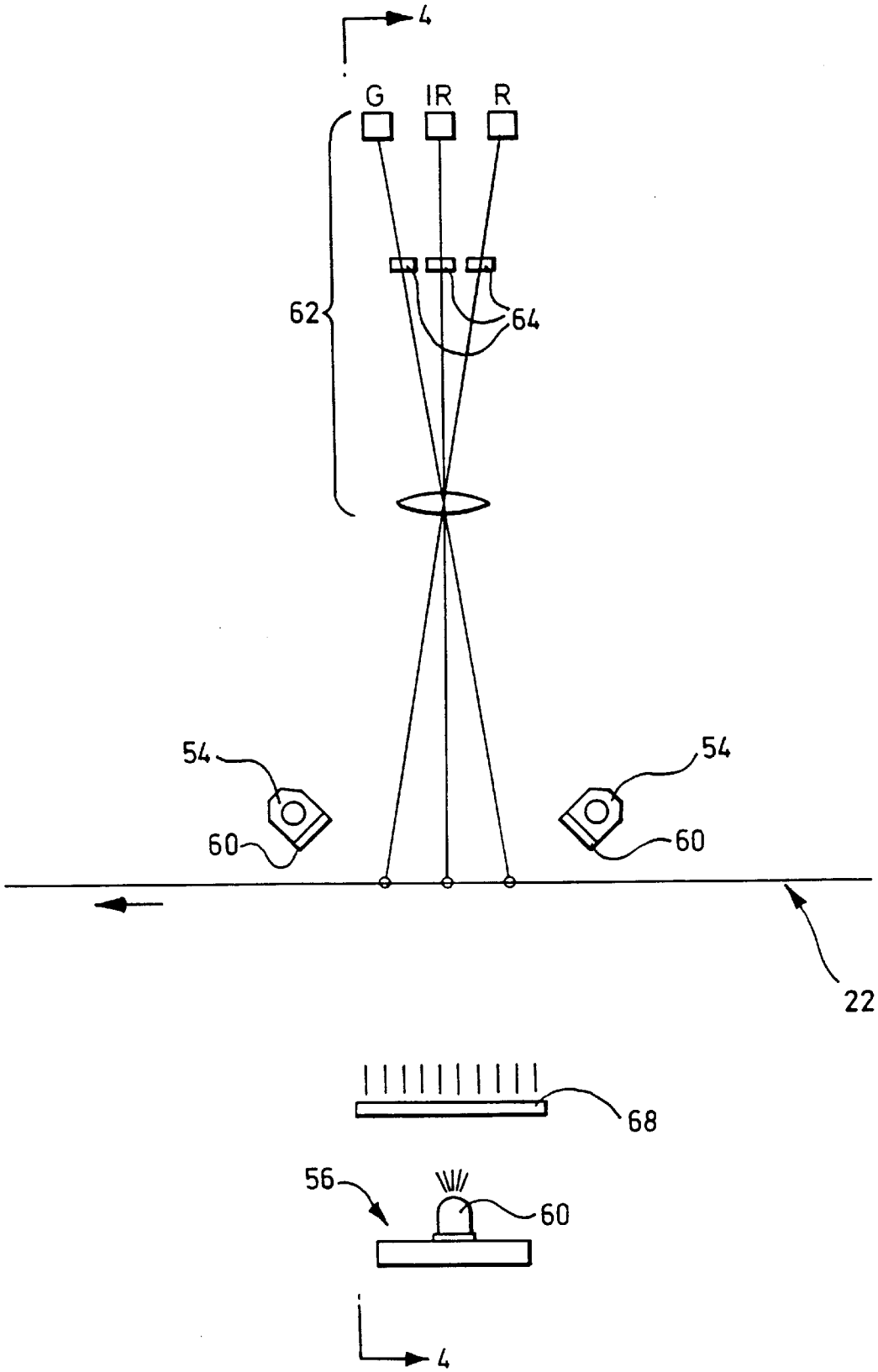
FIG. 3 shows a further modification of the apparatus of FIG. 1.
Figure 4:
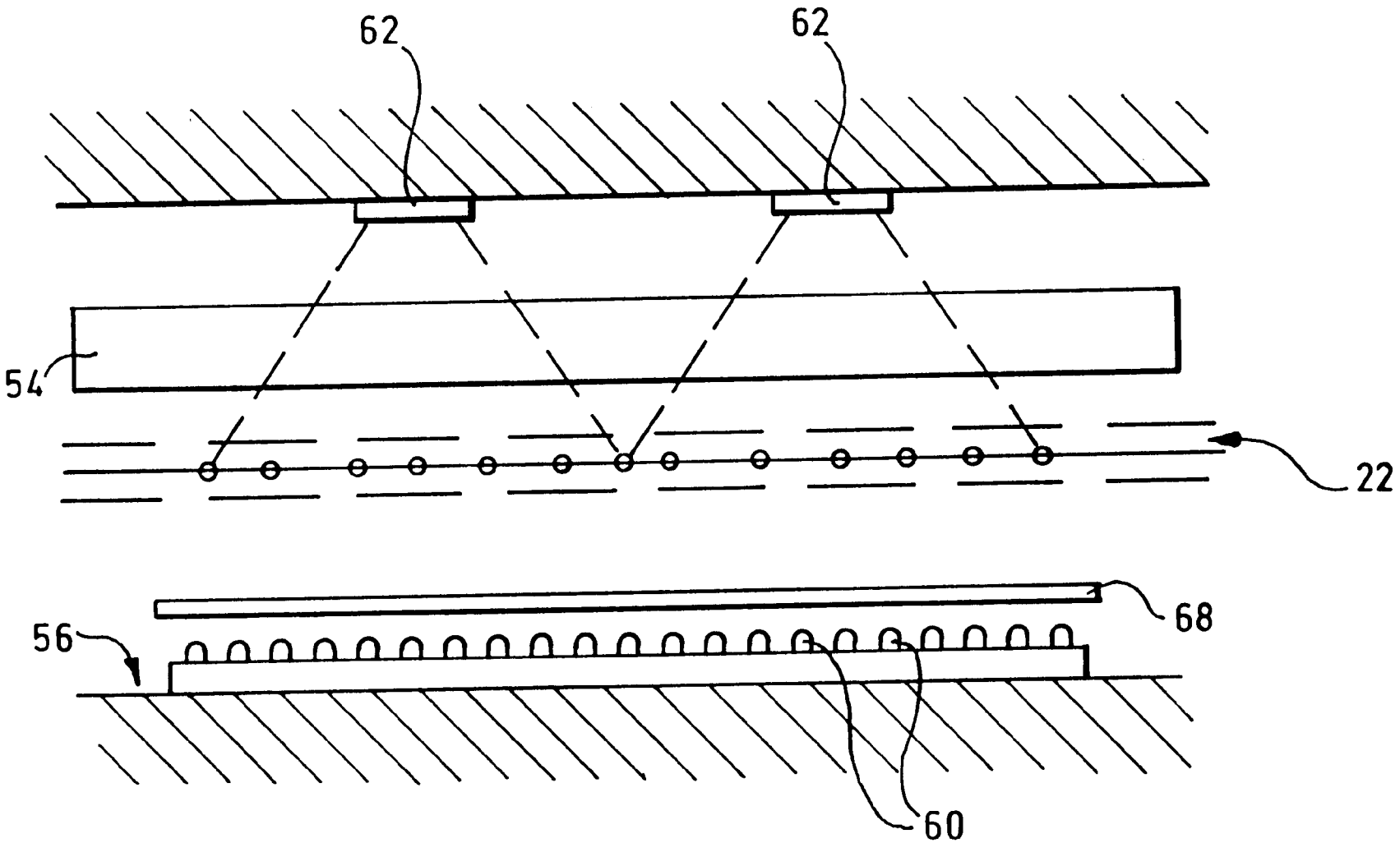
FIG. 4 is a sectional view of the arrangement shown in FIG. 3 taken on line 4—4.

In the further modification shown in FIG. 3 a single camera 62 is used to monitor not only light reflected from particles in the product stream 8 in the scanning region 22, but also light transmitted across the scanning region 22 from a source 56, preferably of infra-red. The scanning region is illuminated from the camera side of the region 22 by light sources 54. Light reflected from particles in the region 22 in the green, red, and infra-red wavelength ranges is received by the camera 62, through respective filters 64, which camera generates signals indicative of the quality of products in the stream, generally as described above. These signals are passed to the computer 16 which upon analysis and establishing the presence of a selected product piece in the viewing zone, issues a signal to the ejectors 12 to eject the respective product piece. As three reflected wavelength ranges are being monitored this is effectively a trichomatic sorting process.

As with the embodiments of FIGS. 1 and 2, the embodiment of FIG. 3 also includes a source, preferably of infra-red light 56 on the opposite side of the product stream from the camera 62. This serves the same purpose as it does in the other embodiments, but infra-red light transmitted across the product stream is also received by the camera 62. The signals generated by the CCDs responsive to light in the infra-red wavelength will differ substantially depending upon the presence or absence of a product piece from the scanning zone. If there is no product piece, then the flood of light transmitted across the scanning zone will cause the camera to generate a corresponding signal which is recognised by the computer as indicating the absence of a product piece from the scanning zone, and it will therefore inhibit further analysis of signals generated by the camera from this section of the product stream as discussed above. The CCDs are able to generate signals of this kind because of the intensity of the infra-red light emitted from the source 56 and the quantity of light transmitted through the scanning zone in the absence of a product piece therefrom will be of the order of twice the amount of light received when a product piece is present, even when the product piece is white. Thus, when the amount of light received is below a threshold value, then the respective signals generated by the camera 62 will be recognized by the computer as relating to a product piece in the viewing zone, and analysis of all signals received will be continued in the usual way.

The infra-red source 56 may comprise an array consisting of one, two or more rows of light emitting, possibly flashing diodes (LEDs) providing diffuse but intense background illumination. A single row of LEDs 60 can be used with a fresnel lens 68 in front as shown.

As an alternative to the use of filters 64 in the scanning system described above with reference to FIG. 3, polaroid filters 60 can be included between the light sources 54 and the viewing zone 22, with cross polaroid filters on the respective CCDs in the camera 62 which are monitoring light in the "green" and "red" wavelength ranges. The use of polarizing filters can relieve problems arising from the specular reflection of light reflected from product in the scanning region 22. However, while this does enhance the quality of the light received by the camera 62, it does reduce the overall quantity and therefore requires the respective CCDs to be more sensitive than might otherwise be necessary. The use of polarised light in sorting apparatus is discussed in U.S. Pat. No. 3,066,797 to which reference is directed.

The embodiments of the invention described above are given by way of example only, and illustrate various ways the invention may be put into effect. Variations can be made, and alternative equipment can be used, without departing from the spirit and scope of the invention claimed herein.

What is claimed is:

1. Sorting apparatus comprising a viewing station and an ejection station, and means for moving a stream of product pieces along a predetermined path through the viewing and ejection stations; means for illuminating the viewing station from one side with light for reflection from product therein; a scanning system on said one side of the viewing station for analysing light emitted therefrom, the emitted light including visible light reflected from product pieces passing through the viewing station, which scanning system comprises an array of light sensors for receiving said emitted light, and a computer for analysing signals generated by the light sensors to establish the presence and acceptability of product pieces passing through the viewing station, for generating an inhibit signal in response to establishing the absence of a product piece and a reject signal in response to establishing the presence of a selected product piece in a viewing zone of the stream, the computer responding to an inhibit signal by precluding analysis of other signals generated by the sensors in response to light received from said zone, and being connected to ejecting means at the ejection station whereby a reject signal causes activation of the ejecting means to eject said selected product piece, and including means for transmitting from the other side of the viewing station a beam of light of higher intensity than that of any diffused light reflected from product pieces in the viewing station, the scanning system being adapted to received such transmitted light.

2. Apparatus according to claim 1 wherein the means for transmitting said beam from the other side of the viewing station comprises a source of infra-red light.

3. Apparatus according to claim 1 or claim 2 wherein the light sensor receiving the transmitted light monitors the quantity of light received from the other side of the viewing station and generates a signal indicative of the presence or absence of a product piece from the viewing zone.

4. Apparatus according to claim 2 wherein the computer generates an inhibit signal in response to generation by the transmitted light sensor of a signal indicative of the absence of a product piece from the viewing zone but in the absence thereof, analyses the light received by the transmitted light sensor to classify the product piece in the viewing zone according to dark and/or light criteria.

5. Apparatus according to claim 1 wherein the means for transmitting said beam from the other side of the viewing station comprises an array of light emitting diodes.

6. Apparatus according to claim 1 wherein the means for transmitting said beam from the other side of the viewing station comprises a single row of LEDs and a fresnel lens between the LEDs and the path of the product stream.

7. Apparatus according to claim 5 or claim 6 wherein the LEDS emit infra-red light.

* * * * *